US011492736B2

(12) United States Patent
Dorjgurkhem et al.

(10) Patent No.: US 11,492,736 B2
(45) **Date of Patent: *Nov. 8, 2022**

(54) KNITTED COMPONENT WITH INLAID CUSHIONING

(71) Applicant: NIKE, Inc., Beaverton, OR (US)

(72) Inventors: Enkhbat Dorjgurkhem, Lake Oswego, OR (US); Derek A. Fitchett, Beaverton, OR (US); Kristen E. Orme, Portland, OR (US); Colin M. Runkle, Portland, OR (US); Gagandeep Singh, Beaverton, OR (US); Dolores S. Thompson, Beaverton, OR (US); Erin E. Toraya, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 154 days.

This patent is subject to a terminal disclaimer.

(21) Appl. No.: 16/383,275

(22) Filed: Apr. 12, 2019

(65) Prior Publication Data

US 2019/0313738 A1 Oct. 17, 2019

Related U.S. Application Data

(60) Provisional application No. 62/657,451, filed on Apr. 13, 2018.

(51) Int. Cl.
*D04B 1/12* (2006.01)
*A43B 23/02* (2006.01)

(52) U.S. Cl.
CPC ..... *D04B 1/123* (2013.01); *A43B 23/028* (2013.01); *D10B 2501/043* (2013.01)

(58) Field of Classification Search
CPC ... D04B 7/14; D04B 7/18; D04B 9/16; D04B 11/10
See application file for complete search history.

(56) References Cited

U.S. PATENT DOCUMENTS 3,965,833 A * 6/1976 Frohlich ..... A44B 19/343 112/475.16
4,733,546 A * 3/1988 Toda ..... D04B 1/12 66/202

(Continued)

FOREIGN PATENT DOCUMENTS

CN 103844428 A 6/2014
DE 102017126047 A1 * 5/2019 ..... B68G 7/02

(Continued)

OTHER PUBLICATIONS

International Search Report and Written Opinion dated Jul. 7, 2019 for PCT Application No. PCT/US2019/026566 (13 pp.).

*Primary Examiner* — Khoa D Huynh
*Assistant Examiner* — Grace Huang
(74) *Attorney, Agent, or Firm* — Shook, Hardy & Bacon L.L.P.

(57) ABSTRACT

A knitted component may include a knit element with a first surface and an opposite second surface. An inlaid yarn may extend through the knit element and between the first surface and the second surface. A secured area where the first surface and the second surface are secured together may be included, where the inlaid yarn is secured by loops forming the first surface and the second surface. A cushioning area may be included, where the cushioning area has a tubular construction such that the first surface and the second surface are separable, forming a cavity therebetween, and where the inlaid yarn extends through the cavity formed between the first surface and the second surface.

20 Claims, 10 Drawing Sheets

(56) References Cited

U.S. PATENT DOCUMENTS

| | | | | |
|---|---|---|---|---|
| 4,736,531 | A * | 4/1988 | Richard | A43B 5/00 36/31 |
| 5,133,199 | A * | 7/1992 | Parikh | D04B 21/12 602/76 |
| 5,211,672 | A * | 5/1993 | Andujar | A63B 71/1225 36/114 |
| 5,543,194 | A * | 8/1996 | Rudy | D04B 21/16 36/43 |
| 6,658,835 | B1 * | 12/2003 | Bowers | D02G 3/445 57/210 |
| 6,673,982 | B1 | 1/2004 | Chen et al. | |
| 6,981,394 | B2 * | 1/2006 | Keller | D04B 21/02 28/163 |
| 7,086,423 | B2 * | 8/2006 | Keller | D04B 21/04 139/116.5 |
| 7,380,420 | B1 * | 6/2008 | Liu | D04B 21/18 66/195 |
| 8,522,577 | B2 | 9/2013 | Huffa | |
| 8,536,076 | B1 * | 9/2013 | Byles | D04B 1/123 442/312 |
| 9,226,540 | B2 * | 1/2016 | Podhajny | D04B 15/56 |
| 9,320,312 | B2 * | 4/2016 | Lyttle | A43B 1/00 |
| 9,551,095 | B2 * | 1/2017 | Lee | D04B 15/367 |
| 9,845,068 | B2 * | 12/2017 | Ise | D03D 15/573 |
| 10,011,925 | B2 * | 7/2018 | Kurahashi | D02G 3/32 |
| 10,165,810 | B2 * | 1/2019 | Takata | D02G 3/12 |
| 10,194,711 | B2 * | 2/2019 | Dua | D04B 1/16 |
| 10,415,164 | B2 * | 9/2019 | Diaz | D04B 1/246 |
| 10,781,541 | B2 * | 9/2020 | Goijarts | D04B 1/18 |
| 10,791,791 | B2 * | 10/2020 | Cox | A43B 23/0245 |
| 11,044,963 | B2 * | 6/2021 | Love | A43B 5/02 |
| 11,168,415 | B2 * | 11/2021 | Henin | D02G 1/0286 |
| 2003/0145632 | A1 | 8/2003 | Roe | |
| 2004/0060328 | A1 * | 4/2004 | Soeda | D04B 1/16 66/196 |
| 2010/0154256 | A1 | 6/2010 | Dua | |
| 2010/0229606 | A1 * | 9/2010 | Ikenaga | B60N 2/58 66/196 |
| 2012/0100386 | A1 * | 4/2012 | Honma | D02G 3/441 428/592 |
| 2012/0233884 | A1 | 9/2012 | Greene | |
| 2013/0037163 | A1 * | 2/2013 | Teshima | D02G 3/406 139/420 R |
| 2013/0059495 | A1 * | 3/2013 | Dempster | D01D 5/22 442/181 |
| 2017/0211214 | A1 * | 7/2017 | Kuo | A43B 1/04 |
| 2019/0037967 | A1 * | 2/2019 | McFarland, II | A43B 23/026 |
| 2019/0111543 | A1 * | 4/2019 | Kyynarainen | B24D 11/005 |
| 2020/0085121 | A1 * | 3/2020 | Morganti | A41D 31/065 |
| 2020/0340152 | A1 * | 10/2020 | Mueller | D04B 21/10 |
| 2020/0354867 | A1 * | 11/2020 | Mueller | B68G 7/02 |
| 2020/0385896 | A1 * | 12/2020 | Srivastava | D06N 3/0036 |

FOREIGN PATENT DOCUMENTS

| | | | |
|---|---|---|---|
| EP | 0 279 950 | A2 | 8/1988 |
| EP | 3 263 755 | A1 | 1/2018 |
| WO | 2009/025556 | A1 | 2/2009 |

* cited by examiner

KNITTED COMPONENT WITH INLAID CUSHIONING

RELATED APPLICATION

This application claims the benefit of U.S. Provisional Application No. 62/657,451, filed Apr. 13, 2018, which is hereby incorporated by reference in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like-referenced numerals designate corresponding parts throughout the different views.

DETAILED DESCRIPTION

Figure 1:
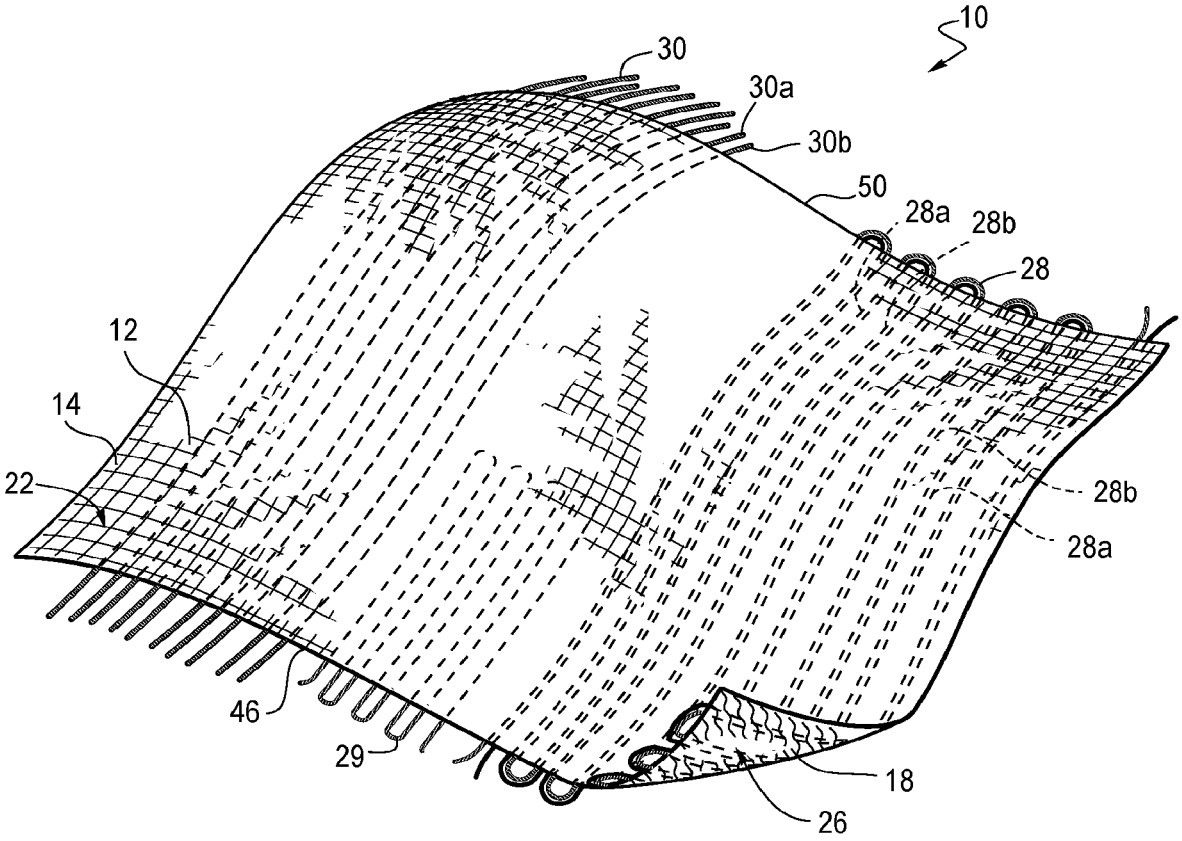
FIG. 1 is an illustration showing a knitted component with inlaid yarns in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

One general aspect of the present disclosure includes a knitted component, including: a knit element having a first surface and an opposite second surface; an inlaid yarn extending through the knit element and between the first surface and the second surface; a secured area where the first surface and the second surfaces are secured together, and where the inlaid yarn is secured by loops forming the first surface and the second surface; and a cushioning area, where the cushioning area includes a tubular construction such that the first surface and the second surface are separable, forming a cavity therebetween, and where the inlaid yarn extends through the cavity formed between the first surface and the second surface.

Another general aspect of the present disclosure includes a knitted component, including: a knit element having a cushioning area and a secured area, where the cushioning area and the secured area have a first surface and an opposite second surface, the first and second surfaces being separable in the cushioning area; and an inlaid yarn extending through the knit element and between the first surface and the second surface in the secured area and the cushioning area, where in the secured area, each of the first and second surfaces is formed by at least a first course and a second course, where in the secured area, the first course and the second course have at least one intermeshed loop, where in the secured area, a first segment of the inlaid yarn extends through the first course in the secured area, and a second segment of the inlaid yarn extends through the second course, where in the cushioning area, the first course is located on a first side of the inlaid yarn such that it forms the first surface, and where in the cushioning area, the second course is located on a second side of the inlaid yarn such that it forms the second surface.

Another general aspect of the present disclosure includes an upper for an article of footwear, the upper including: a knitted component having a knit element formed with a plurality of courses and having a first surface and an opposite second surface, the plurality of courses including a first course and a second course; the first course having a set of first loops and the second course having a set of second loops; an inlaid yarn, extending through at least one of the first course and the second course; and a cushioning area, where in the cushioning area, each of the first loops is located on a first side of the inlaid yarn and forms the first surface, and where in the cushioning area, each of the second loops is located on a second side of the inlaid yarn and forms the second surface.

Another general aspect of the present disclosure includes a knitted component, including: a first layer and a second layer, where the first layer and the second layer are secured via at least one common yarn extending at least partially through a boundary region, where the first layer includes a first cushion, where the second layer includes a second cushion, and where the second layer is inverted with respect to the first layer such that the first layer and the second layer overlap.

Another general aspect of the present disclosure includes an upper for an article of footwear, including: a knitted component having a first layer and a second layer, where the first layer and the second layer are secured via at least one common yarn, where the first layer includes a first cushion, where the second layer includes a second cushion, and where the second layer is inverted with respect to the first layer such that the first layer and the second layer overlap.

Another general aspect of the present disclosure includes a upper for an article of footwear, including: a first layer and a second layer, the first layer forming an exterior surface of the upper and the second layer forming an interior surface of the upper, the first layer and the second layer being at least partially coextensive, where the second layer is formed of a knitted component, the knitting component including a tubular knit structure with an inlaid cushioning yarn extending therethrough to form a first cushion, and where the cushion contacts the first layer.

Another general aspect of the present disclosure includes an article of footwear, including: a knitted component, the knitted component forming at least a portion of an upper and an underfoot area of the article of footwear, where the underfoot area includes at least one cushion, the at least one cushion including an inlaid cushioning yarn extending through a tubular knit construction of the knitted component.

Referring to FIG. 1, a knitted component 10 suitable for a number of applications, e.g., footwear, apparel, and industrial textiles, is shown. Knitted component 10 may be formed as an integral one-piece element from a single knitting process, such as a weft knitting process (e.g., with a flat knitting machine with one, two, or more needle beds, or with a circular knitting machine), a warp knitting process, or any other suitable knitting process. The process that forms knitted component 10 may be a hybrid knitting process, in that one or more materials that form knitted component 10 are not knitted. For example, one or more materials (e.g., yarns or strands) of knitted component 10 may be inlaid. As used in this application, a yarn may include a strand, and is not intended to limit the present disclosure to multifilament materials. The process that forms knitted component 10 may substantially form the knit structure of knitted component 10 without the need for significant post-knitting processes or steps. Alternatively, two or more portions of knitted component 10 may be formed separately as distinct integral one-piece elements, and then the respective elements may be attached.

The primary elements of knitted component 10 are a knit element 12 and one or more inlaid yarns 28, 29, 30. Knit element 12 may incorporate various types of yarn that impart different properties to separate areas of knit element 12. That is, one area of knit element 12 may be formed from a first type of yarn that imparts a first set of properties, and another area of knit element 12 may be formed from a second type of yarn that imparts a second set of properties. In this configuration, properties may vary throughout knit element 12 by selecting specific yarns for different areas of knit element 12. The properties that a particular type of yarn will impart to an area of knit element 12 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knit element 12 may affect the properties of knit element 12. For example, a yarn forming knit element 12 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of knit element 12. Accordingly, both the materials forming the yarn and other aspects of the yarn may be selected to impart a variety of properties to separate areas of knit element 12.

Knit element 12 is formed from at least one yarn that is manipulated (e.g., with a knitting machine) to form a plurality of intermeshed loops that define a variety of courses and wales. That is, knit element 12 has the structure of a knit textile. Knit element 12 may include at least a first layer 14 and a second layer 18. First layer 14 and second layer 18 may be formed on one or more needle beds of a knitting machine, e.g., a first needle bed and/or a second needle bed. When one or both of first and second layers 14, 18 are formed on more than one needle bed, or when first and second layers 14, 18 are formed on different needle beds, then resulting knit element 12 is a multi-bed knit element. As used in this application, first layer 14 may form a first surface 22 comprising a first plurality of knit loops, and second layer 18 may form a second surface 26 comprising a second plurality of knit loops. First layer 14 may overlap at least a portion of second layer 18, and first and second layers 14, 18 may be coterminous in one or more dimensions; however, first and second layers 14, 18 do not need to be coterminous. At least a portion of first layer 14 may be freely separable from second layer 18. In other words, first layer 14 and second layer 18 may have one or more portions with opposite facing surfaces, thereby making those portions of first layer 14 freely separable from second layer 18. That is, first surface 22 may generally face a first direction, and second surface 26 may generally face the opposite direction. Although first layer 14 may be freely separable from second layer 18 in certain areas, it does not need to be freely separable. For example, knit element 12 may include one or more interlayer knit stitches (e.g., stitches formed during the same knitting process and extending between a first needle bed and a second needle bed). Such interlayer knit stitches may be formed by the same yarn(s) that forms first and/or second layers 14, 18, or a different yarn. In one example, at least one course of yarn may form a portion of both first layer 14 and second layer 18, e.g., a knit structure formed on both first and second needle beds that includes the first plurality of knit loops on first surface 22 and the second plurality of loops on second surface 26. For example, in an interlock knit structure or similar structure that includes one or more courses having loops formed on both a first and a second needle bed, each course may form at least a part of both first and second layers 14, 18. Alternatively, different courses of yarn may form first and second layers 14, 18, e.g., a first course may form a single jersey first layer on a first needle bed and a second course may form a single jersey second layer on a second needle bed, where at least a portion of the single jersey first layer is separable from the single jersey second layer (e.g., see section B, surfaces 22, 26 of FIGS. 3A-3B). Knit element 12 may receive additional layers, e.g., to enhance strength, provide cushioning protection, or for other advantages. In various non-limiting applications, first layer 14 or second layer 18 may correspond with at least part of an outer or inner layer of an article of apparel or industrial textile, an exterior or interior layer of an upper for an article of footwear, or a layer of another application.

First and second layers 14, 18 may each include one or more materials selected to impart advantageous properties to knit element 12. For example, first layer 14 may eventually correspond with an exterior layer of an article of footwear, such as when the article has been assembled and is configured to accommodate the foot of a wearer, and therefore may include courses of a relatively inelastic first yarn providing abrasion resistance, water resistance and/or durability. Suitable materials for first layer 14 may include polyester yarns, e.g., polyester yarns having a maximum tensile strength of at least approximately 0.5 kg-f (e.g., ranging from approximately 0.5 kg-f to approximately 3.0 kg-f) and a linear density of at least approximately 150 denier (e.g., ranging from approximately 150 to approximately 1,500 denier). First layer 14 may also be weatherized, e.g., it may be formed from yarns having water repellant and or resistant properties or it may have a durable water repellent finish.

Second layer 18 may eventually correspond with an interior layer of an article of footwear, such as when the article has been assembled and is configured to accommodate the foot of a wearer, and therefore, second layer 18 may include one or more courses of yarn having a relatively soft hand, for example a yarn having a napped finish or otherwise provide breathability and comfort to the wearer. Additionally or alternatively, second layer 18 may include one or more elasticized yarns to give resiliency to knit element 12. The examples are non-limiting and are intended to illustrate the versatility of first and second layers 14, 18 which may be formed from the same yarn(s) or different yarns or a combination thereof to provide advantageous properties to the respective layers, and/or different portions, areas or regions of the respective layers, as necessary or desired.

Figure 2:
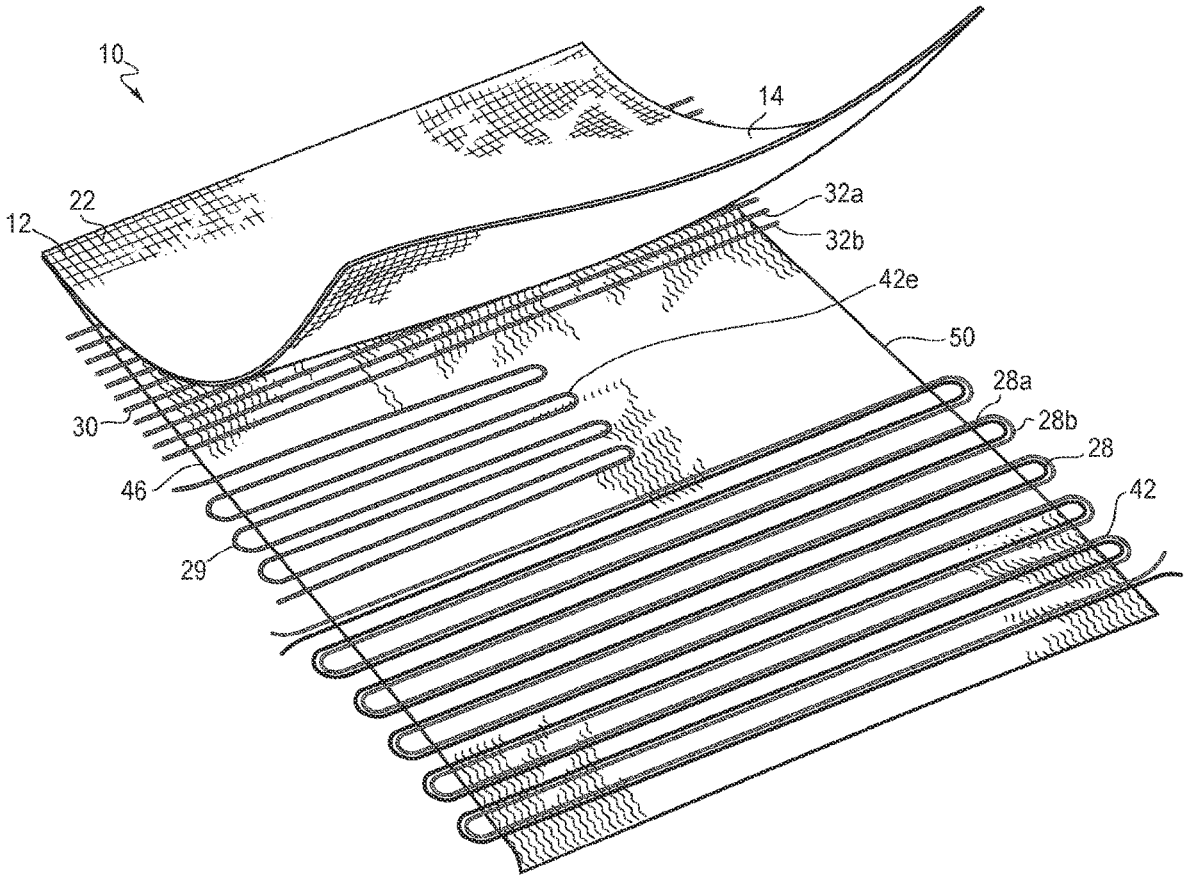
FIG. 2 is an illustration showing a representative cutaway view of the knitted component of FIG. 1.

Referring still to FIG. 1 and also to the representative cutaway view of FIG. 2 (and it is noted that, in practice, the layers may not be capable of being separated as depicted in FIG. 2), knitted component 10 may include one or more yarns located between first and second surfaces 22, 26 (and also potentially between the first and second layers 14, 18 if/when they are included) to reinforce knitted component 10, improve strength (e.g., tensile strength), to impart directional stretch resistance, to enhance compressibility, to create an attractive appearance, to increase resistance to penetration, and/or for other advantages. When incorporated into an upper of an article of footwear, the one or more yarns located between first and second layers 14, 18 may assist with securing the upper around the foot, limit deformation in areas of upper (e.g., imparts stretch-resistance), and/or provide cushioning protection to selected areas of the upper, etc. For example, the depicted knitted component 10 includes a first inlaid yarn 28, a second inlaid yarn 29, and a third inlaid yarn 30. It will be appreciated that FIG. 2 is representative; although the optional first layer 14 is illustrated as separated from the optional second layer 18 (e.g., in order to illustrate the inlaid yarns 28-30), first layer 14 does not need to be freely-separable from second layer 18. Further, the inlaid yarns 28-30 may be formed between first and second surfaces 22, 26 as a result of the same process that forms knit element 12. In other words, inlaid yarns 28-30 may be part of the same, integrally-formed knitted component 10. Although inlaid yarns 28-30 generally extend along courses within knit element 12, inlaid yarns 28-30 may also (or alternatively) extend along wales within knit element 12.

Inlaid yarns 28-30 may each include one or more cushioning yarns inlaid within the knit element 12. A cushioning yarn may have a full diameter (e.g., when not restricted or compressed) of about 1/16" or larger, for example, though other cushioning yarns may have other diameters (e.g., 1/8", 1/4", or even larger). Two non-limiting exemplary examples of cushioning yarns are a 5500 denier version and a 3500 denier version of multifilament polyester yarn that has been texturized to loft. Particular examples are marketed as "LILY" yarns and are sold by Sawada Hong Kong Co. Ltd., though other yarns from other manufacturers may also be cushioning yarns. In this application, one or more cushioning yarns may be inlaid such that it is placed in front of loops of some yarns and behind others (e.g., between loops formed on a first and a second needle bed). For example, an inlaid cushioning yarn may be placed in front of loops of a second yarn being held on a first needle bed, and behind loops of the second yarn (or a third yarn) being held on a second needle bed. As another example, an inlaid cushioning yarn may be placed in front of first layer 14 and behind second layer 18; in such cases, first layer 14 and second layer 18 may or may not be freely separable. Subsequently, one or more yarns held on the first and second needle beds may be interlooped with additional courses of yarn and/or tucked on another needle bed, thus closing or securing the inlaid yarn within knit element 12 and effectively integrating the inlaid yarn into the integrally-knitted structure of knitted component 10. In this way, an inlaid yarn may have portions that are not interlooped with other yarns of knitted component 10, i.e., the inlaid yarn may have portions that may appear to extend straight through at least part of knit element 12. This may be accomplished on a knitting machine, e.g., with a combination feeder or an inlay feeder, for example as described in U.S. Pat. No. 8,522,577, which is hereby incorporated by reference in its entirety.

The courses of the knit element 12 that hold segments of an inlaid cushioning yarn may have a spaced relationship (where a "segment" in this context means a portion of the inlaid cushioning yarn extending through one course). In some examples, a cushioning yarn may be inlaid within two consecutive courses of the knit element 12 (e.g., two courses that have intermeshed loops) In other embodiments, at least one course of the knit element 12 may be located between segments of an inlaid cushioning yarn, such as one, two, three, four, five, six, seven, eight, nine, ten, or even more courses. For example, when a first segment of a cushioning yarn is inlaid in between loops of a first course of the knit element 12, and when a second segment of that same cushioning yarn is inlaid between loops of a second course of the knit element 12 (when no other segments are located between the first and second segments), the first course and the second course may be consecutive, and thus the first course may have loops that are intermeshed with loops of the second course. Alternatively, the first course and the second course may be separated by one, two, three, four, five, six, seven, eight, nine, ten, or even more courses of the knit element 12.

In some embodiments, an inlaid cushioning yarn may extend through the entirety of the knit element 12. For example, first inlaid yarns 28 (which is depicted as two yarns inlaid together, each having 11 inlaid segments) may extend from first edge 46 to second edge 50. Alternatively, some inlaid yarns may extend only partially through the knit element 12, such as second inlaid yarn 29 (depicted as one yarn having 8 inlaid segments). Further, each inlaid segment of the cushioning yarn may be formed by one continuous yarn (such as inlaid segments 28*a* and 28*b* of first inlaid yarn 28, which extends across at least a portion of knit element 12 in a snake-like or zig-zag pattern), or by distinct, individual ends of yarn (such as inlaid segments 30*a* and 30*b* of third inlaid yarn(s) 30). In either case, one or more segments of cushioning yarn(s) may extend beyond one or more edges of knit element 12, such as inlaid segments 28*a* and 28*b* (which form a loop or hair-pin-like turn, for example, to extend back through the knit element 12 two or more times in such a pattern) and inlaid segments 30*a* and 30*b*.

Suitable yarns forming the courses of the knit element 12 (e.g., the loops forming the first layer 14 and/or the second layer 18) may include polyester and other compositions formed into yarns having a tenacity in the range of at least approximately six grams-force per denier, e.g., approximately 6-10 grams-force per denier. For example, polyester yarns having linear densities ranging from approximately 275-325 denier and a maximum tensile strength of at least 1,650 grams-force may be appropriate.

Figure 3A:
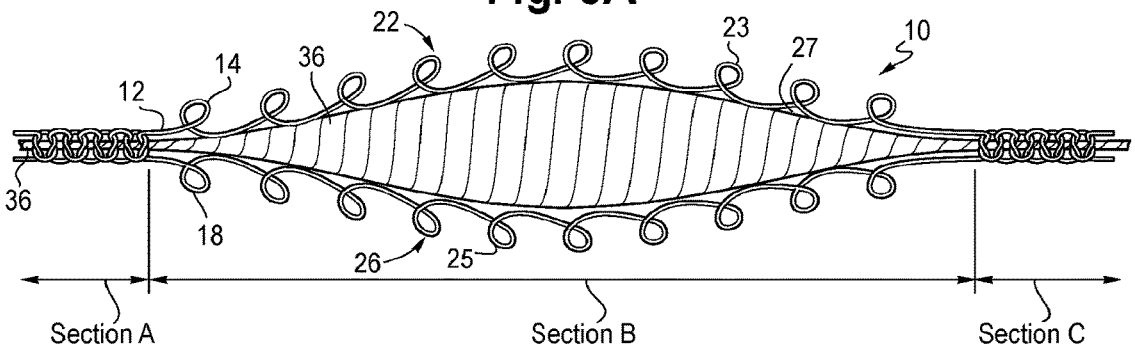
FIG. 3A is an illustration showing a representative top view of an inlaid cushioning yarn extending through a knit element in accordance with certain aspects of the present disclosure.
Figure 3B:
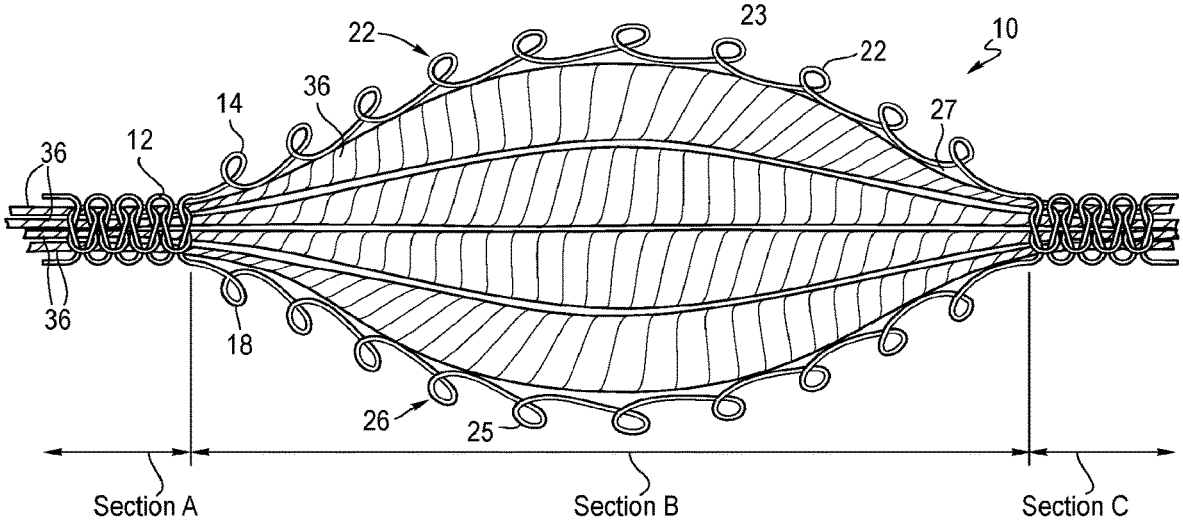
FIG. 3B is an illustration showing a representative top view of multiple inlaid cushioning yarns extending through a knit element in accordance with certain aspects of the present disclosure.

As shown in FIGS. 3A-3B, the knitted component 10 is depicted with two areas where the first surface 22 and the second surface 26 are secured (herein referred to as "secured areas") shown as section A and section C. The secured areas where first surface 22 and second surface 26 are not separable may be formed with a double jersey knit structure or another knit structure where yarns are manipulated by needles of two needle beds. An inlaid yarn 36 (which may be any one of the inlaid yarns 28, 29, or 30 as described above) may extend through the double jersey knit structure or other suitable structure such that it is relatively secured in place with respect to the first and second surfaces 22, 26. Section B, representing an area of tubular construction where the first surface 22 and the second surface 26 are separable (thus forming a cavity 27 therebetween), is depicted between the two secured areas section A and section C. As shown, each of a set of first loops 23 forming the first surface are located on a first side of the inlaid yarn 36, and the first loops 23 are all formed in sequence from the same continuous yarn. Similarly, each of a set of second loops 25 forming the second surface 26 are located on an opposite second side of the inlaid yarn 36, and the second loops 25 are all formed in sequence from the same continuous yarn. The yarns forming the first loops 23 and the second loops 26 may alternate between the first and the second sides of the inlaid yarn 36, in the secured areas (e.g., section A, C, as shown). The secured areas of knitted component 10 (e.g., sections A, C) may be positioned at the sides or edges of the knitted component 10, and additionally or alternatively, may be positioned adjacent to and/or around the unsecured area (e.g., section B).

Inlaid portions of cushioning yarn 36 located between first and second surfaces 22, 26 may pass from the secured areas (sections A and C) and through the tubular structure in section B. One or more cushioning yarns 36 may be inlaid together (e.g., one cushioning yarn 36 as shown in FIG. 3A, or more than one cushioning yarn 36 as shown in 3B). In the unsecured area, cushioning yarn(s) 36 may be substantially free to expand to, or remain in, a lofted or expanded state such that a maximum diameter may be reached. That is, in the tubular structure of Section B, inlaid segments of cushioning yarn 36 have the freedom to extend radially outward to reach their respective maximum diameters. This may push first and second surfaces 22, 26 radially outward to form a "pillow-like," and the interior volume or cavity 27 between first and second surfaces 22, 26 may be filled with the material of the cushioning yarn 36. In contrast, portions of cushioning yarn 36 that are located in the secured areas (e.g., sections A, C) are in a relatively restricted or compressed state such that the maximum diameter of the cushioning yarn is not reached. The degree of restriction/compression may be varied by varying the stitch density of the knit element, by varying the elasticity of the yarns forming the knit element 12, etc. In some embodiments, the diameter of the cushioning yarn 36 in the unsecured areas (e.g., section B) is at least 50% larger than its diameter in the secured areas (e.g., section A, C), such as twice as large, 3 times as large, 5 times as large, or even larger. In other words, in the depicted embodiment, the portions of cushioning yarn 36 located within the unsecured areas (e.g., section B) are free to expand into a first diameter within the interior volume formed between first and second surfaces 22, 26, while portions of cushioning yarn 36 located within the secured areas (e.g., sections A, C) are restricted by the knit element 12 to a smaller second diameter. In this manner, the unsecured areas (e.g., section B) may protrude from the secured areas (e.g., sections A, C) that are adjacent to or at least partially surrounding the unsecured areas in a visible manner (e.g., FIGS. 4A-4B).

Figure 4A:
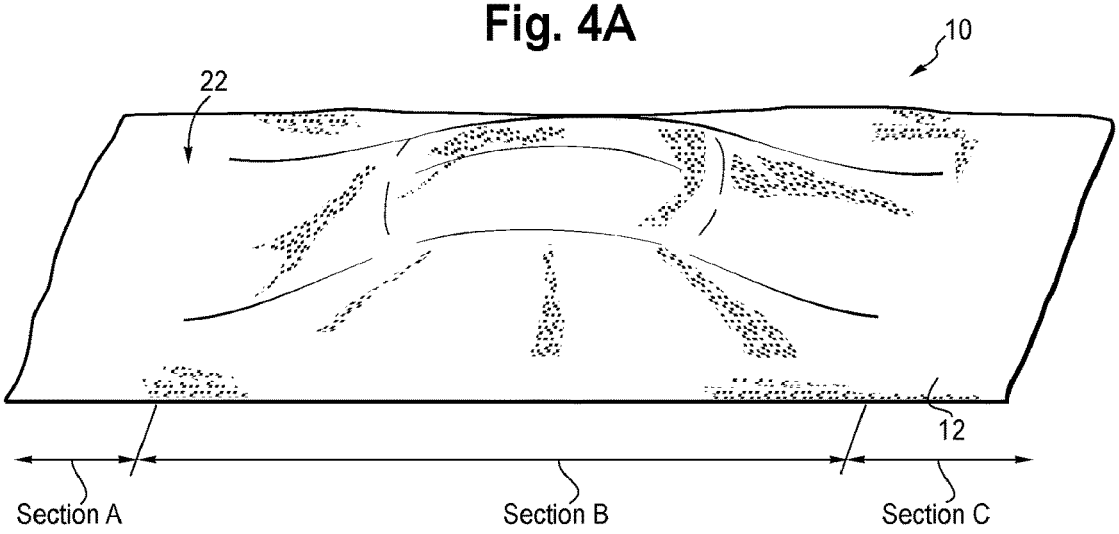
FIG. 4A is an illustration showing a front perspective view of a knitted component with a cushion in accordance with certain aspects of the present disclosure.
Figure 4B:
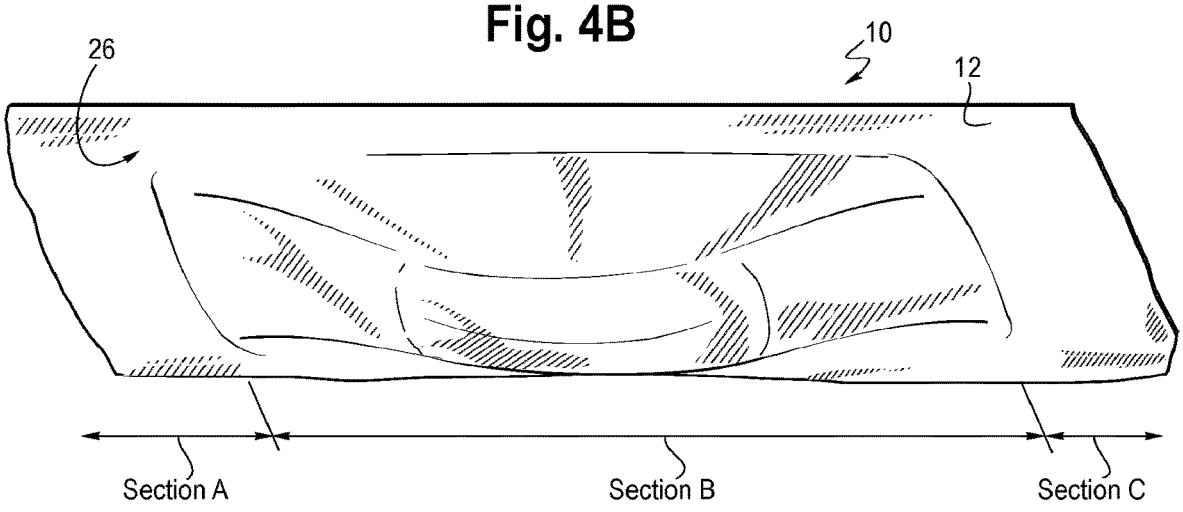
FIG. 4B is an illustration showing a back perspective view of a knitted component with a cushion in accordance with certain aspects of the present disclosure.

For example, referring to FIGS. 4A-4B, which show first surface 22 and second surface 26, the unsecured areas (e.g., section B) may protrude at least ⅛" (e.g., ¼", ½", or even more) from at least one of first surface 22 and second surface 26 in the unsecured areas (e.g., section B). In secured areas (e.g., section A and section C), the knitted component 10 may be substantially flat on both surfaces 22, 26, and it may appear identical or similar to a knitted component without inlaid cushioning yarns at all (since the cushioning yarns are compressed within the knit element 12).

The ability of inlaid cushioning yarns to reach their respectively-expanded diameters imparts a compressible aspect to the unsecured area (e.g., section B), such that the inlaid cushioning area may be formed. By having the unsecured area surrounded by or adjacent to secured areas, the unsecured area is positioned within a certain zone in the knitted component 10. Further, referring back to FIGS. 3A-3B, while the inlaid cushioning yarns 36 may be relatively secured in place with respect to the first and second surfaces 22, 26, the inlaid cushioning yarns 36 have some freedom to move relative to first and second surfaces 22, 26 within the unsecured area. An advantage of this configuration is that an inlaid cushioning area may be integrally formed within the one-piece knitted component 10 during the same process as the entire remainder of the one-piece knitted component 10, without the need for inserting a separate cushioning component into the knitted component 10 after knitting processes. Integrally formed knitted components with inlaid cushioning areas provide a variety of advantages over conventional cushioning constructions. As noted above, conventional cushioning constructions are formed by inserting separate cushioning components into voids within previously formed knitted components. Conventional cushioning components may be composed of foam materials, fluid-filled bladders, or other cushioning elements used singularly or in combination with other elements. As the number and type of cushioning components and voids within knitted components increases, the time and expense associated with transporting, stocking, cutting, and joining (e.g., stitching, bonding) the cushioning components and the voids within knitted components may also increase. Moreover, knitted components with a greater number of separately joined (e.g., inserted) cushioning components may be more difficult to recycle than knitted components with inlaid cushioning yarns. Waste material from cutting and stitching processes also accumulates to a greater degree as the number and type of cushioning components and voids within knitted components increases. By integrally forming a knitted component with inlaid cushioning areas, waste may be decreased, recyclability may be simplified, manufacturing efficiency may be increased, and manufacturing costs may be reduced.

Figure 5:
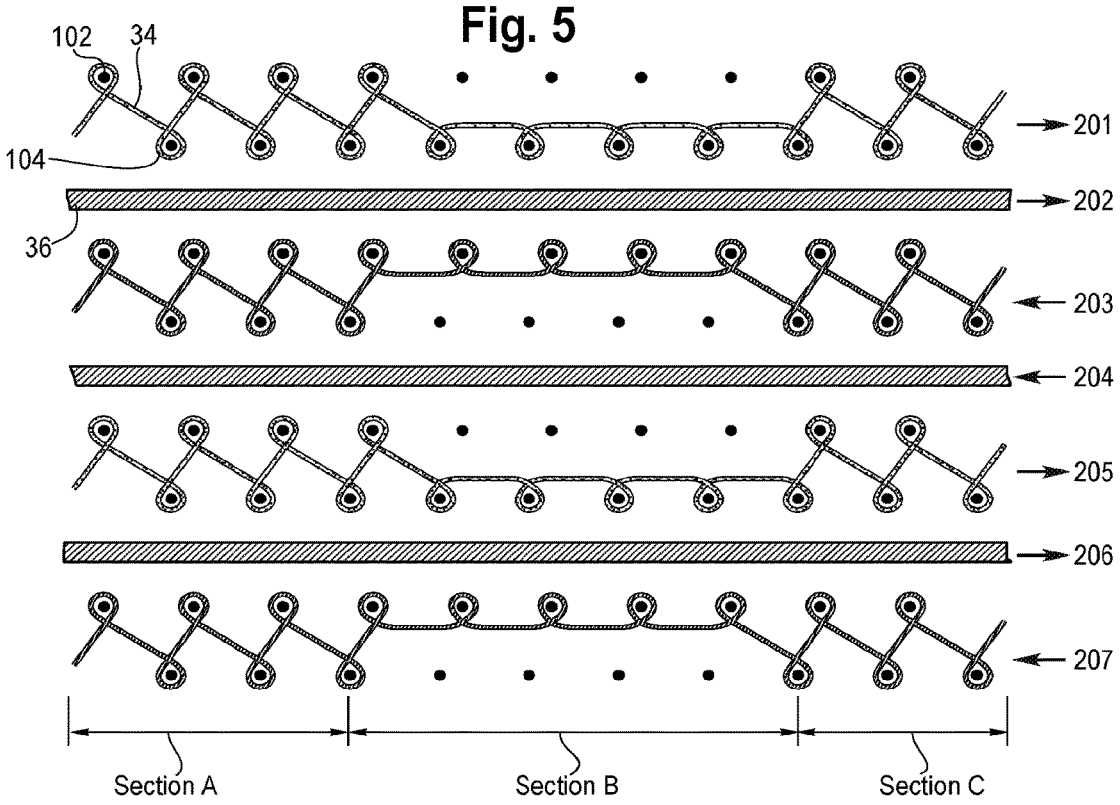
FIG. 5 is an illustration showing a knitting sequence for forming a knitted component with a cushioning area in accordance with certain aspects of the present disclosure.

FIG. 5 shows a knitting sequence that may be utilized to form the integrally-knitted component 10 as described above, such as through a weft knitting process (e.g., with a flat knitting machine with one, two, or more needle beds). The non-limiting sequence of FIG. 5 is illustrated on a weft knitting machine having a first needle bed 102 and a second needle bed 104. Loops formed on the first needle bed 102 may generally form first surface 22 (e.g., as shown in FIG. 3B) and loops formed on the second needle bed 104 may generally form the second surface 26 (e.g., FIG. 3B). The loops may be formed with a yarn 34 (e.g., a polyester yarn), and an inlaid yarn 36 may be inlaid within the loops. The inlaid yarn 36 may be a cushioning yarn as described above. Sections A, B, and C may correspond with like-named sections above (e.g., in FIG. 3A).

In a first step 201, the machine may form loops of yarn 34 on both the first and second needle beds 102, 104 with a double jersey knit structure in section A, only on the second needle bed 104 in a single jersey knit structure in section B, and then again on both needle beds 102, 104 in section C. Next, in a second step 202, the machine may inlay the cushioning yarn 36 between the first needle bed 102 and second needle bed 104. In a third step 203, another course of yarn 34 (which may be a common continuous yarn) may be formed that is similar to the course of first step 201 except in section B, the loops of the yarn 34 are located on the first needle bed 102. In a fourth step 204, another cushioning yarn 36 (or multiple cushioning yarns) may again be inlaid such that the cushioning yarns 36 are inlaid in consecutive courses. When these steps are repeated (e.g., steps 205-207 are the same as steps 201-203, respectively), the resulting knitted component will have two secured areas corresponding with sections A, C where the yarn 36 is substantially secured with respect to the first and second surfaces 22, 26 (e.g., FIG. 3A). In section B, the knitted component will have a tubular construction since the loops on the first needle bed 102 and the second needle bed 104 do not interlock, thereby forming an unsecured area (e.g., cushioning area) in accordance with the above description.

Figure 6:
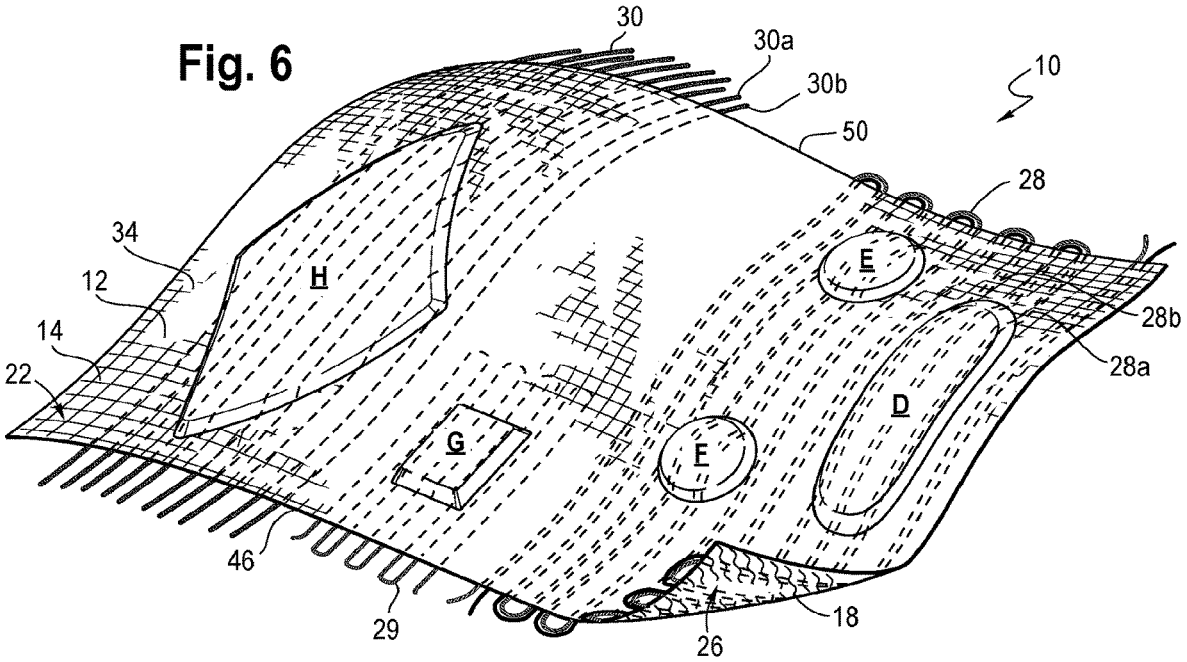
FIG. 6 shows a knitted component with various cushioning areas in accordance with certain aspects of the present disclosure.

The knit structures formed by the sequence of FIG. 5 are for illustration only and may differ in the number of needles used, the number of skipped needles, the specific knit structures (e.g., tucks vs. loops), the size of certain sections/areas, etc. By using various knit structures, knitted component 10 may incorporate various inlaid cushioning areas with varying dimensions and shapes, thereby imparting specific properties and advantages to different areas of knitted component 10. For example, by varying the number of courses and/or wales of yarn 34 within the unsecured area (e.g., section B), the dimension and shape of the cushioning areas may be varied accordingly. Referring to FIG. 6, knitted component 10 shows various inlaid cushioning areas D-H having different knit structures, different dimensions and shapes, and different degrees of cushioning. For example, cushioning areas D, E, F are similarly in the shape of an ellipse, while cushioning area D has a larger dimension than cushioning areas E and F by incorporating a larger tubular structure in the course-wise direction (e.g., through utilizing more unsecured loops along the courses) within cushioning area D. As another example, cushioning area H has a larger dimension than cushioning area E by incorporating a larger number of wales and courses within cushioning area H. As yet another example, cushioning areas H and G have different dimensions and shapes by using varying tubular knit constructions or structures with different numbers of wales, different numbers of courses, and/or different numbers of loops.

Moreover, by combining various cushioning yarn types with the knit structures, knitted component 10 may impart a range of cushioning and/or stiffness to different areas. In some embodiments, the type of cushioning yarns used for forming inlaid cushioning areas extending between first and second surfaces 22, 26 may be varied. For example, by varying the thickness of the cushioning yarns used to form inlaid cushioning areas, the amount or degree of cushioning may be similarly varied. In some cases, by inlaying a thinner cushioning yarn into knit element 12, a smaller degree of compressibility and/or resiliency may be provided between first and second surfaces 22, 26 in the cushioning area, thereby making the inlaid cushioning area easier to compress. In other cases, by inlaying a thicker cushioning yarn into knit element 12, a larger degree of compressibility and/or resiliency may be provided between first and second surfaces 22, 26 in the cushioning area, thereby making the inlaid cushioning area harder to compress and providing additional or increased padding and/or cushioning.

Additionally or alternatively, the number of cushioning yarns used for forming inlaid cushioning areas extending between first and second surfaces 22, 26 may be varied. For example, more than one end of the cushioning yarn may be inlaid together (optionally in a twisted configuration, or not) within a course of knit element 12. By varying the number of cushioning yarns used to extend through each course of the knit element 12, the amount or degree of cushioning may be similarly varied. In some cases, by extending a smaller number of cushioning yarns through each course of the knit element 12, a smaller degree of compressibility and/or resiliency may be provided between first and second surfaces 22, 26 in the unsecured area, thereby making the inlaid cushioning area easier to compress. In other cases, by extending a greater number of cushioning yarns through each course of the knit element 12 in the unsecured area, a larger degree of resiliency may be provided between first and second surfaces 22, 26 in the unsecured area, thereby making the inlaid cushioning area harder to compress and providing additional or increased padding and/or cushioning. Referring back to FIG. 3B, the inlaid cushioning area (section B) is depicted to illustrate a relatively high degree of cushioning, at least in part, due to more than one cushioning yarn (in this case four) being inlaid through the course of the knit element 12 and extending together through the cavity of the unsecured area (section B).

When knitted component 10 is incorporated into an upper of an article of footwear, different types of yarns may be selected to impart varying stretch-resistance, wear-resistance, flexibility, air-permeability, compressibility, comfort, color, and moisture-wicking to different areas of knitted component 10, thereby imparting proper properties and advantages to different areas of the upper. For example, the upper may include inlaid cushioning areas with different levels of cushioning/stiffness at selected locations with respect to the skeletal structure and other anatomy of a wearer's foot to provide cushioning protection and/or stability for the wearer's foot. For example, cushioning areas with a lesser relative stiffness in compression may be positioned at locations most likely to experience impact loads during running and like activities. Cushioning areas with a greater relative stiffness in compression may be positioned at locations where impact loads are unlikely and greater resistance is needed to stabilize the running motion. Cushions of the type described above may be located in any suitable location, such as in a toe area of the upper, a medial and/or lateral side of the upper in a midfoot area, a heel area, a throat area, an ankle area and/or collar area, an external or internal surface layer, etc. Several non-limiting examples are described below for purposes of illustration.

Figure 8:
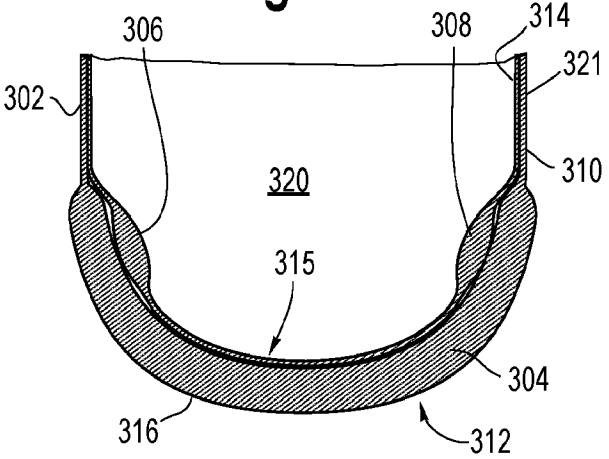
FIGS. 8-9 are illustrations showing various sectional views of the article of footwear depicted in FIG. 7.
Figure 7:
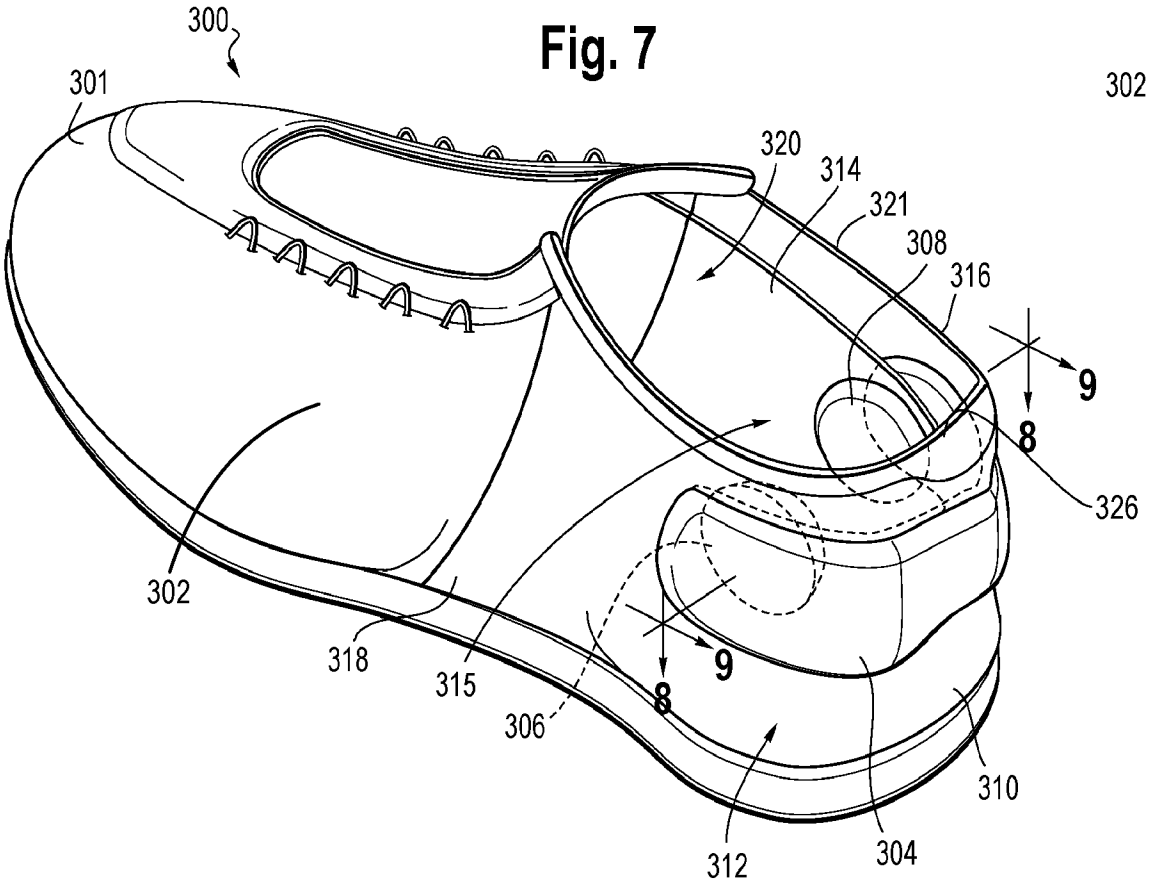
FIG. 7 is an illustration showing a perspective view of an article of footwear having cushions in accordance with certain aspects of the present disclosure.

FIGS. 7-8 show an example of an article of footwear that may be formed with a knitted component 302 having cushioning areas, forming cushions 304, 306, 308. The cushions 304, 306, 308 may be formed in accordance with the aspects above, and thus the knitted component 302 may be integral and have inlaid cushioning yarns that fill a cavity formed within a tubular knit construction of the cushions 304, 306, 308.

As shown in FIG. 8, the knitted component 302 may include a first layer 310 (e.g., an outer layer forming an exterior surface 312 of the upper 301) and a second layer 314 (e.g., an inner layer forming an interior surface 315 of the upper 301). The first layer 310 may include the first cushion 304. The first cushion may extend along the heel area 316 of the upper 301 from a lateral side 318 to a medial side 321, and the first cushion 304 may be exposed and visible on the exterior surface 312. The first cushion 304 may also protrude towards the void 320, as shown.

Figure 9:
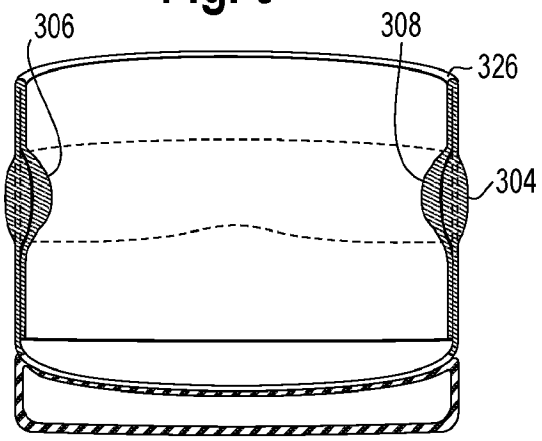

The second layer 314 may include the second cushion 306 and the third cushion 308. The second and third cushions 306,308 may be located for communication with ankles of a wearer when the article of footwear 300 is in use (as depicted by FIGS. 7-9). In other embodiments, the second and third cushions 306,308 may be located for communication with the achilles tendon. That is, the second cushion 306 may be located just laterally with respect to an achilles of a wearer, and the third cushion 308 may be located just medially of the achilles. Advantageously, the second cushion 306 and the third cushion 308 may provide a comfortable, snug fit (e.g., particularly in the heel area) and may provide enhanced achilles support with respect to other embodiments.

The first layer 310 and the second layer 314 may overlap such that they are at least partially coextensive. For example, referring to FIGS. 8-9, the second layer 314 may be inverted with respect to the first layer 310 (as described in more detail below), and thus the first cushion 304 may contact at least one of the second cushion 306 and the third cushion 308. This may be advantageous for providing enhanced cushioning characteristics to the second cushion 306 and the third cushion 308 since they may be forced, by the first cushion 304, to protrude towards the void 320. In other embodiments, at least one of the second cushion 306 and the third cushion 308 may be offset with respect to the first cushion 304, and/or at least one of the first cushion 304, the second cushion 306 and the third cushion 308 may not be included.

Figure 10:
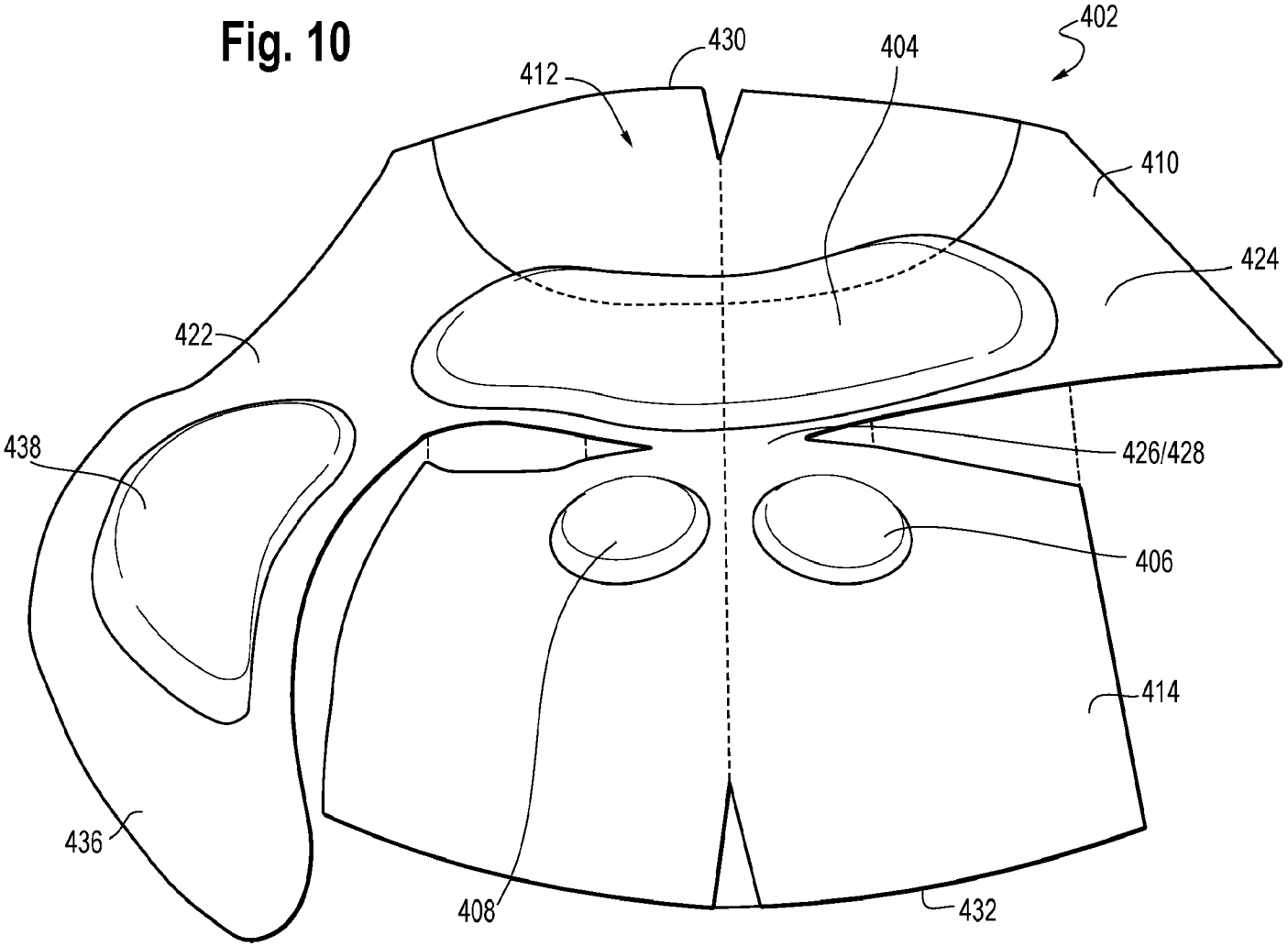
FIG. 10 is an illustration showing a knitted component with cushions after it is removed from a knitting machine and prior to incorporation into an upper for an article of footwear in accordance with certain aspects of the present disclosure.

FIG. 10 shows an example of a knitted component 402 similar to the knitted component 302 of FIGS. 7-9, but in a flat orientation (e.g., as it may appear when it is initially removed from a knitting machine and prior to being folded or otherwise manipulated into a shape for use in an article of footwear). Like the above-described knitted component of FIGS. 7-9, the knitted component 402 of FIG. 10 includes a first cushion 404, a second cushion 406, and a third cushion 408. The second and third cushions 406, 408 are positioned for communication with an achilles tendon of a user, and the first cushion 404 is positioned to be exposed on an exterior surface 412 (as described above).

The first cushion 404 is located in a first layer 410, and the second and third cushions 406, 408 are located in a second layer 414. It is noted that the first layer 410 and the second layer 414 may be knitted at different times, and each have their own sub-layers (e.g., when two needle beds are used, as described above). Thus, the first cushion 404 may have a tubular construction with separable surfaces forming an unsecured area, and/or cavity, such that a cushioning yarn can expand into its full diameter. Areas 422, 424 may be secured areas that also include the inlaid cushioning yarn (but in a secured configuration where the cushioning yarn's diameter is restricted/compressed by knitted loops). The second cushion 406 and/or the third cushion 408, and corresponding areas surrounding the same, may have a similar construction.

As shown, the first layer 410 and the second layer 414 may be formed with the same integral knitted component 402 (e.g., formed together in the knitting machine without being connected via a seam afterwards), and thus the first layer 410 and the second layer 414 may share a common yarn. The common yarn may be an inlaid yarn and/or a yarn forming knitted loops. For example, the common yarn may form knitted loops at a boundary region 426. The boundary region 426 may be the point where the first layer 410 meets the second layer 414. Further, the knitted component 402 may be folded at the boundary region 426 when being manipulated to form an upper for an article of footwear such that the second layer 414 becomes inverted with respect to the first layer 410. As a result, the first layer 410 and the second layer 414 may become coextensive and overlap, and the second cushion 406 and/or the third cushion 408 may contact the first cushion 404 (as shown in FIGS. 7-9).

When the knitted component 402 is manipulated into its wearable shape, the boundary region 426 may be located at the collar 428 (see, e.g., boundary region 326 of FIG. 9). The edge 430 of the first layer 410 and the edge 432 of the second layer 414, which may be terminal edges, may extend towards a sole structure and/or the bottom of the void. In some embodiments, the edge 430 of the first layer 410 may end proximate a biteline of the article of footwear, and the edge 432 of the second layer 414 may end near or at the bottom of the void of the article of footwear, though other edge locations are also contemplated.

Optionally, the knitted component 402 may include an additional portion 436 with a fourth cushion 438. The additional portion 436 may be shaped and positioned (or otherwise configured) to form another surface of the upper, for example a side medial surface, a tongue, a bottom surface, etc. Thus, the fourth cushion 438 may be located at a variety of positions of the upper to provide cushioning and/or support in a variety of places. In the depicted embodiment of FIG. 9, the additional portion 436 may extend to the throat area of the upper, and thus the fourth cushion 438 may provide cushioning in the throat area.

Figure 11:
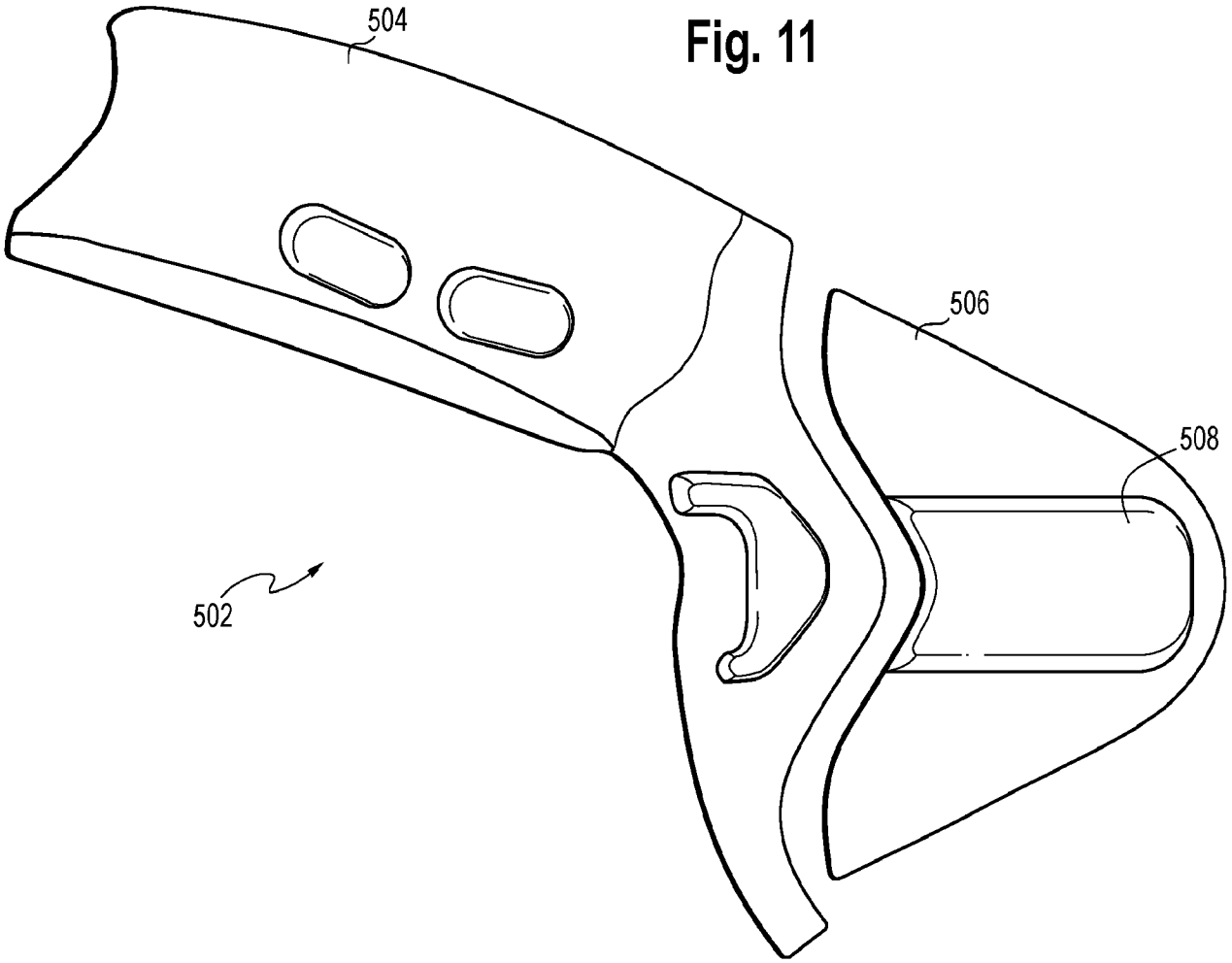
FIG. 11 is an illustration showing two knitted components with cushions after they are removed from a knitting machine and prior to assembly and incorporation into an upper for an article of footwear in accordance with certain aspects of the present disclosure.

In some embodiments, such as the embodiment depicted in FIG. 11, an upper 502 may include separate knitted components 504, 506 that are sewn or otherwise secured together to complete the upper 502. While not shown, additional non-knit elements (and/or additional knitted components) may also be included to complete the shape of the upper. For example, a first knitted component 504 (with two layers configured to overlap, similar to the embodiment of FIG. 10) may be knitted separately from a second knitted component 506. The second knitted component 506 may generally be configured to form a throat area and/or a tongue of the upper, and it may include a throat-area cushion 508. The throat-area cushion 508 may have features and characteristics of any of the cushions described above, and may be advantageous for providing a comfortable fit and/or for protecting the top surface of the foot. Other knitted components with cushions for being located in other areas may also be included.

Figure 13:
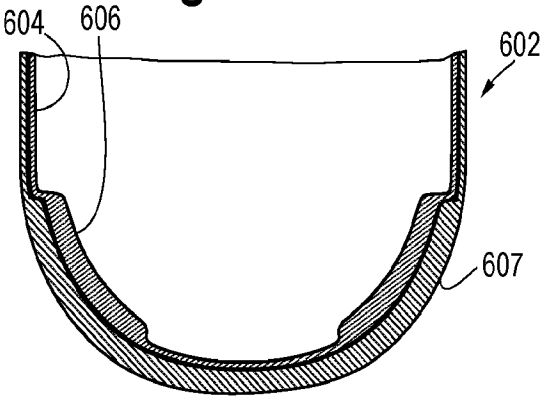
FIGS. 13-14 are illustrations showing various sectional views of the article of footwear depicted in FIG. 12.
Figure 14:
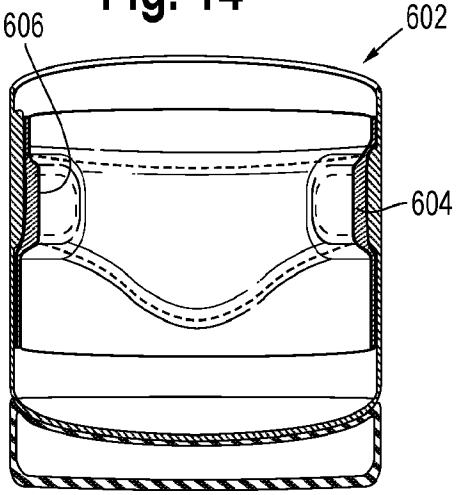
Figure 12:
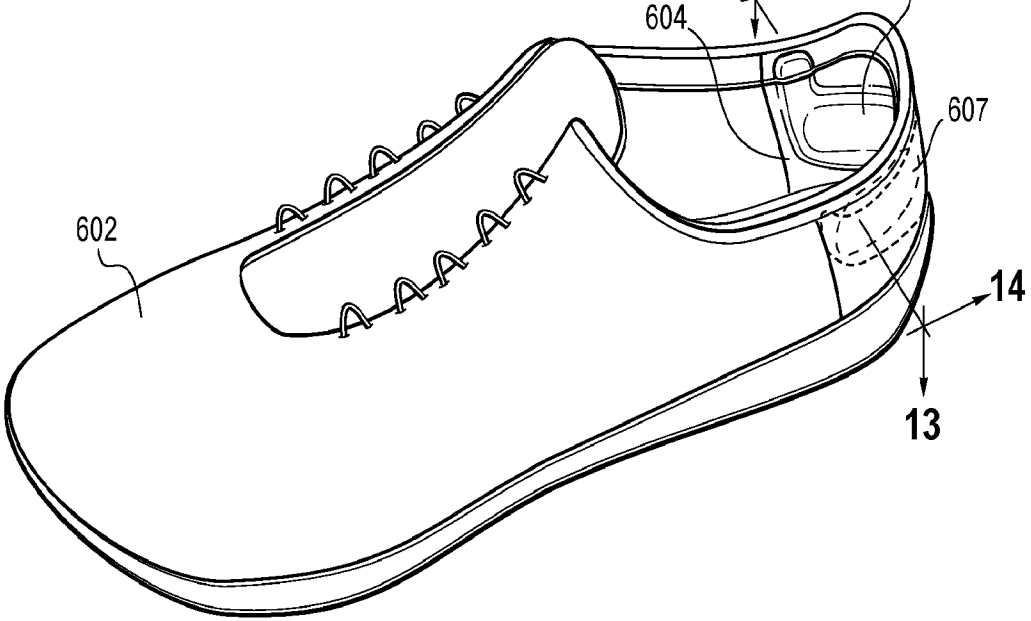
FIG. 12 is an illustration showing a perspective view of an article of footwear having an upper and a separate knitted component with cushions in accordance with certain aspects of the present disclosure.

As shown in FIGS. 12-14, an upper 602, which may or may not be formed of a knitted component, may be attached to a separate knitted component 604 that includes a cushion 606 in accordance with the embodiments above. The knitted component 604 may be secured to the rest of the upper 602 by sewing, using an adhesive, or by any other suitable method. While the knitted component 604 can be located at any suitable location, it may be advantageous to locate the knitted component 604 in the heel area 607 of the article of footwear (as depicted) such to provide enhanced heel cushioning. In other embodiments, the knitted component 604 may have more than one cushion (e.g., it may include a pair of achilles cushions, as described above with reference to FIGS. 7-10).

Figure 15:
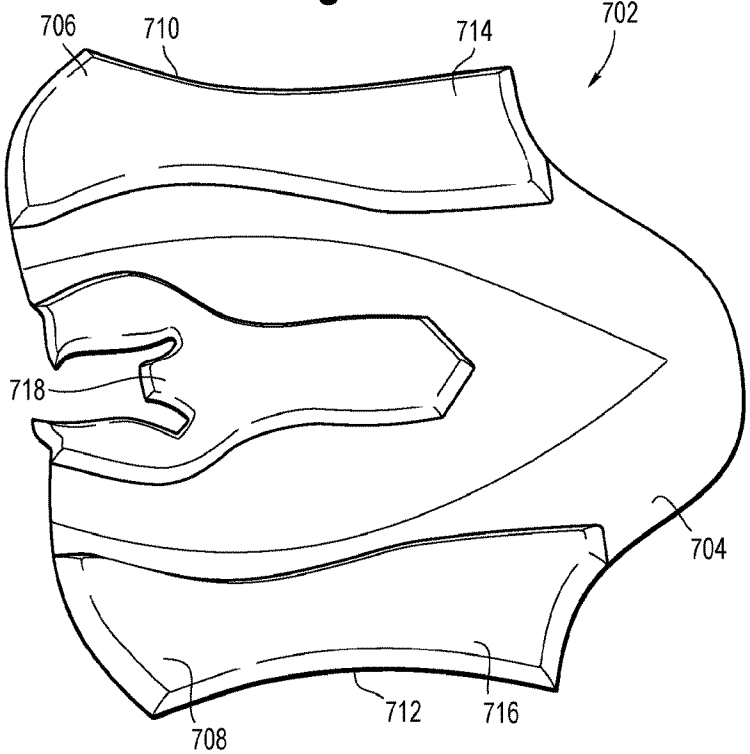
FIG. 15 is an illustration showing a knitted component with underfoot portions having cushions, and a throat-area cushion, in accordance with certain aspects of the present disclosure.

FIG. 15 shows another embodiment of a knitted component 704 for forming an upper 702. The knitted component 704 includes a lateral underfoot portion 706 and a medial underfoot portion 708 shaped and positioned to connect at their respective edges 710, 712, therefore forming an underfoot portion of the upper that will be located under the void (and foot of the wearer) when the upper is in use. Other configurations may also provide an underfoot area.

Figure 16:
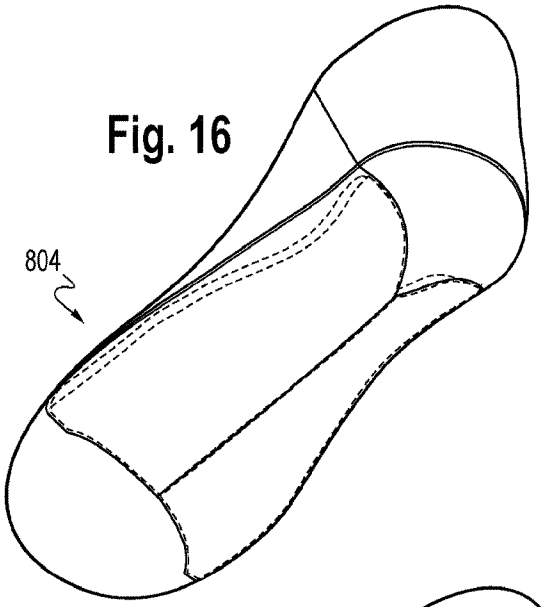
FIGS. 16-17 are illustrations showing views of an upper with underfoot cushions in accordance with certain aspects of the present disclosure.
Figure 17:
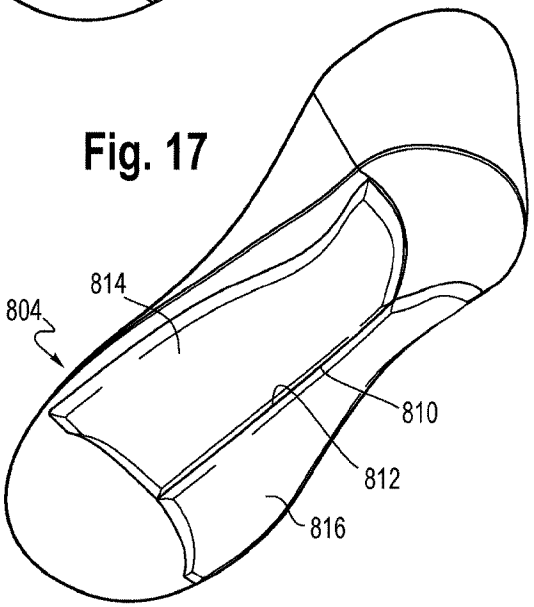

As shown, a first cushion 714 and a second cushion 716 may be located, respectively, on the lateral underfoot portion 706 and the medial underfoot portion 708. When manipulated into a wearable shape, the first and second cushions 714, 716 may provide advantageous underfoot cushioning, thereby potentially eliminating the need to use a midsole and/or other underfoot component. The embodiment of FIG. 15 also includes an optional third cushion 718 in the throat area. FIGS. 16-17 show views of an upper 804 similar to the upper 702 of FIG. 15 (but without the third cushion 718) after the knitted component has been folded into its wearable shape. As shown, the edges 810, 812 meet at an underfoot area, and the first and second cushions 814, 816 are now located beneath the void of the upper 804. Optionally, a sole may be attached to the underfoot area beneath the cushions.

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

We claim:

1. A knitted component, comprising:

a knit element comprised of a plurality of yarns, the knit element comprising:

a first layer forming a first surface and a second layer forming an opposite second surface;

a secured area where at least a first knit loop of the knit element forms a portion of both the first layer and the second layer; and an unsecured area where at least a second knit loop of the knit element forms a portion of the first layer and not the second layer, and where at least a third knit loop of the knit element forms a portion of the second layer and not the first layer;

an inlaid yarn extending through the knit element between the first layer and the second layer, wherein the inlaid yarn is a cushioning yarn texturized to loft;

where in the secured area, the inlaid yarn is secured by at least the first knit loop forming the first layer and the second layer; and where the unsecured area comprises a tubular construction such that the first layer and the second layer are separable, forming a cavity there between, such that the inlaid yarn extends through the cavity formed between the first layer and the second layer, wherein the inlaid yarn is lofted to a first diameter in the unsecured area, wherein the inlaid yarn is compressed and has a second diameter in the secured area, and wherein the first diameter is larger than the second diameter.

2. The knitted component of claim 1, wherein in the unsecured area, the second knit loop forming the portion of the first layer is located on a first side of the inlaid yarn, and wherein in the unsecured area, the third knit loop forming the portion of the second layer is located on a second side of the inlaid yarn.

3. The knitted component of claim 1, wherein the first diameter is at least 50% larger than the second diameter.

4. The knitted component of claim 1, wherein the first diameter is at least twice as large as the second diameter.

5. The knitted component of claim 1, wherein the unsecured area is configured to be placed in at least one of an ankle area, a midfoot area, a collar area, a throat area, and an underfoot area of an upper for an article of footwear.

6. The knitted component of claim 1, wherein the first diameter is a maximum diameter.

7. A knitted component, comprising:

a knit element comprised of a plurality of yarns, the knit element having an unsecured area and a secured area, wherein the knit element has a first layer forming a first surface and a second layer forming an opposite second surface, the first layer and second layer being separable in the unsecured area and joined to each other in the secured area, wherein at least a first knit loop of the knit element forms a portion of both the first layer and the second layer in the secured area, wherein at least a second knit loop of the knit element forms a portion of the first layer and not the second layer in the unsecured area, and wherein at least a third knit loop of the knit element forms a portion of the second layer and not the first layer in the unsecured area; and an inlaid yarn extending through the knit element and between the first layer and the second layer in the secured area and the unsecured area, wherein the inlaid yarn is a cushioning yarn texturized to loft, wherein a first segment of the inlaid yarn extends through a first course of the knit element in the secured area and the unsecured area, wherein the inlaid yarn is lofted to a first diameter in the unsecured area, wherein the inlaid yarn is compressed and has a second diameter in the secured area, and wherein the first diameter is larger than the second diameter.

8. The knitted component of claim 7, wherein the secured area is adjacent to the unsecured area and has a double jersey knit structure.

9. The knitted component of claim 7, wherein in the unsecured area, the inlaid yarn is located within a cavity formed between the first layer and the second layer of the knit element.

10. The knitted component of claim 7, wherein in the unsecured area, the second knit loop is located on a first side of the inlaid yarn, and wherein the third knit loop is located on a second side of the inlaid yarn.

11. The knitted component of claim 7, wherein the first diameter is at least 50% larger than the second diameter.

12. The knitted component of claim 7, wherein the first diameter is at least twice as large as the second diameter.

13. The knitted component of claim 7, wherein the first knit loop and the second knit loop are formed from a common continuous yarn.

14. The knitted component of claim 7, wherein the unsecured area is configured to be placed in at least one of an ankle area, a midfoot area, a collar area, a throat area, and an underfoot area of an upper for an article of footwear.

15. The knitted component of claim 7, wherein the first diameter is a maximum diameter, and wherein a second segment of the inlaid yarn extends through a second course in the secured area and the unsecured area of the knit element.

16. An upper for an article of footwear, the upper comprising:

a knitted component having a knit element comprised of a plurality of yarns, the knit element comprising:

a first layer forming a first surface and a second layer forming an opposite second surface;

a secured area where at least a first knit loop of the knit element forms a portion of both the first layer and the second layer; and a first unsecured area where at least a second knit loop of the knit element forms a portion of the first layer and not the second layer, and where at least a third knit loop of the knit element forms a portion of the second layer and not the first layer;

an inlaid yarn texturized to loft, the inlaid yarn extending through the knit element between the first layer and the second layer;

wherein in the first unsecured area, the second knit loop is located on a first side of the inlaid yarn forming the first layer, wherein in the first unsecured area, the third knit loop is located on a second side of the inlaid yarn forming the second layer, and wherein the inlaid yarn is lofted to a first diameter in the first unsecured area, wherein the inlaid yarn is compressed and has a second diameter in the secured area, and wherein the first diameter is larger than the second diameter.

17. The upper of claim 16, further comprising a fourth knit loop in the secured area, wherein the first knit loop is intermeshed with the fourth knit loop in the secured area.

18. The upper of claim 16, wherein the first diameter is at least 50% larger than the second diameter.

19. The upper of claim 16, wherein the first unsecured area is placed in an ankle area of the upper.

20. The upper of claim 16, wherein the knitted component includes a second unsecured area that overlaps the first unsecured area such that the first unsecured area and the second unsecured area are at least partially coextensive.

* * * * *